US008853516B2

(12) United States Patent
Arimoto et al.

(10) Patent No.: US 8,853,516 B2
(45) Date of Patent: Oct. 7, 2014

(54) AUDIO ANALYSIS APPARATUS

(75) Inventors: Keita Arimoto, Barcelona (ES); Sebastian Streich, Rijswijk (NL); Bee Suan Ong, Rijswijk (NL)

(73) Assignee: Yamaha Corporation, Hamamatsu-shi (JP)

( * ) Notice: Subject to any disclaimer, the term of this patent is extended or adjusted under 35 U.S.C. 154(b) by 854 days.

(21) Appl. No.: 13/081,408

(22) Filed: Apr. 6, 2011

(65) Prior Publication Data

US 2011/0268284 A1 Nov. 3, 2011

(30) Foreign Application Priority Data

Apr. 7, 2010 (JP) ..... 2010-088354

(51) Int. Cl.
*G10H 1/00* (2006.01)

(52) U.S. Cl.
USPC ..... 84/600; 84/601; 84/602; 700/94

(58) Field of Classification Search
USPC ..... 84/600–602; 700/94
See application file for complete search history.

(56) References Cited

U.S. PATENT DOCUMENTS

| | | | | |
|---|---|---|---|---|
| 6,430,533 | B1 * | 8/2002 | Kolluru et al. | 704/500 |
| 7,502,312 | B2 * | 3/2009 | Zhang et al. | 370/210 |
| 7,509,294 | B2 * | 3/2009 | Kim | 705/500 |
| 7,659,471 | B2 * | 2/2010 | Eronen | 84/600 |
| 8,712,185 | B2 * | 4/2014 | Ludwig | 382/280 |
| 2002/0005110 | A1 | 1/2002 | Pachet et al. | |
| 2003/0205124 | A1 | 11/2003 | Foote et al. | |
| 2005/0117532 | A1 * | 6/2005 | Zhang et al. | 370/320 |
| 2008/0072741 | A1 * | 3/2008 | Ellis | 84/609 |
| 2008/0236371 | A1 | 10/2008 | Eronen | |
| 2008/0300702 | A1 | 12/2008 | Gomez et al. | |
| 2009/0005890 | A1 * | 1/2009 | Zhang | 700/94 |

(Continued)

FOREIGN PATENT DOCUMENTS

| | | | |
|---|---|---|---|
| EP | 1 577 877 | A1 | 9/2005 |
| EP | 2 093 753 | A1 | 8/2009 |

OTHER PUBLICATIONS

Paulus, J. et al. (2002). "Measuring the Similarity of Rhythmic Patterns," IRCAM, seven pages.

(Continued)

*Primary Examiner* — David S. Warren
(74) *Attorney, Agent, or Firm* — Morrison & Foerster LLP

(57) ABSTRACT

In an audio analysis apparatus, a component acquirer acquires a component matrix composed of an array of component values, columns of the component matrix corresponding to the sequence of unit periods of an audio signal and rows of the component matrix corresponding to a series of unit bands of the audio signal arranged in a frequency-axis direction. A difference generator generates a plurality of shift matrices each obtained by shifting the columns of the component matrix in the time-axis direction with a different shift amount, and generates a plurality of difference matrices each composed of an array of element values in correspondence to the plurality of the shift matrices, the element value representing a difference between the corresponding component values of the shift matrix and the component matrix. A feature amount extractor generates a tonal feature amount including a plurality of series of feature values corresponding to the plurality of difference matrices, one series of feature values corresponding to the series of unit bands of the difference matrix, one feature value representing a sequence of element values arranged in the time-axis direction at the corresponding unit band of the difference matrix.

6 Claims, 6 Drawing Sheets

(56) References Cited

U.S. PATENT DOCUMENTS

| | | | | |
|---|---|---|---|---|
| 2011/0268284 | A1* | 11/2011 | Arimoto et al. | 381/56 |
| 2012/0237041 | A1* | 9/2012 | Pohle | 381/56 |
| 2013/0289756 | A1* | 10/2013 | Resch et al. | 700/94 |
| 2013/0322777 | A1* | 12/2013 | Ludwig | 382/255 |

OTHER PUBLICATIONS

Tsunoo, E. et al. (Mar. 2008). "Rhythmic Features Extraction from Music Acoustic Signals using Harmonic/Non-Harmonic Sound Separation," 2008 Spring Meeting of the Acoustic Society of Japan, pp. 905-906, with English Translation, seven pages.

U.S. Appl. No. 13/081,337, filed Apr. 6, 2011, by Arimoto et al.

Bello, J.P. (Oct. 2009). "Grouping Recorded Music by Structural Similarity," *ISMIR Conference*, Kobe, JP, Oct. 26-30, 2009, six pages.

European Search Report mailed Sep. 2, 2011, for EP Application No. 11161259.4, eight pages.

* cited by examiner

AUDIO ANALYSIS APPARATUS

BACKGROUND OF THE INVENTION

1. Technical Field of the Invention

The present invention relates to a technology for analyzing features of sound.

2. Description of the Related Art

A technology for analyzing features (for example, tone) of music has been suggested in the art. For example, Jouni Paulus and Anssi Klapuri, "Measuring the Similarity of Rhythmic Patterns", Proc. ISMIR 2002, p. 150-156 describes a technology in which the time sequence of the feature amount of each of unit periods (frames) having a predetermined time length, into which an audio signal is divided, is compared between different pieces of music. The feature amount of each unit period includes, for example, Mel-Frequency Cepstral Coefficients (MFCCs) indicating tonal features of an audio signal. A DP matching (Dynamic Time Warping (DTW)) technology, which specifies corresponding locations on the time axis (i.e., corresponding time-axis locations) in pieces of music, is employed to compare the feature amounts of the pieces of music.

However, since respective feature amounts of unit periods over the entire period of an audio signal are required to represent the overall features of the audio signal, the technology of Jouni Paulus and Anssi Klapuri, "Measuring the Similarity of Rhythmic Patterns", Proc. ISMIR 2002, p. 150-156 has a problem in that the amount of data representing feature amounts is large, especially in the case where the time length of the audio signal is long. In addition, since a feature amount extracted in each unit period is set regardless of the time length or tempo of music, an audio signal extension/contraction process such as the above-mentioned DP matching should be performed to compare the features of pieces of music, causing high processing load.

SUMMARY OF THE INVENTION

The invention has been made in view of these circumstances and it is an object of the invention to reduce processing load required to compare tones of audio signals representing pieces of music while reducing the amount of data required to analyze tones of audio signals.

In order to solve the above problems, an audio analysis apparatus according to the invention comprises: a component acquisition part that acquires a component matrix composed of an array of component values from an audio signal which is divided into a sequence of unit periods in a time-axis direction, columns of the component matrix corresponding to the sequence of unit periods of the audio signal and rows of the component matrix corresponding to a series of unit bands of the audio signal arranged in a frequency-axis direction, the component value representing a spectrum component of the audio signal belonging to the corresponding unit period and belonging to the corresponding unit band; a difference generation part that generates a plurality of shift matrices each obtained by shifting the columns of the component matrix in the time-axis direction with a different shift amount, and that generates a plurality of difference matrices each composed of an array of element values in correspondence to the plurality of the shift matrices, the element value representing a difference between the corresponding component value of the shift matrix and the corresponding component value of the component matrix; and a feature amount extraction part that generates a tonal feature amount including a plurality of series of feature values corresponding to the plurality of difference matrices, one series of feature values corresponding to the series of unit bands of the difference matrix, one feature value representing a sequence of element values arranged in the time-axis direction at the corresponding unit band of the difference matrix.

In this configuration, the tendency of temporal change of the tone of the audio signal is represented by a plurality of feature value series. Accordingly, it is possible to reduce the amount of data required to estimate the tone of the audio signal, compared to the prior art configuration (for example, Jouni Paulus and Anssi Klapuri, "Measuring the Similarity of Rhythmic Patterns", Proc. ISMIR 2002, p. 150-156) in which a feature amount is extracted for each unit period. In addition, since the number of the feature value series does not depend on the time length of the audio signal, it is possible to easily compare temporal changes of the tones of audio signals without requiring a process for matching the time axis of each audio signal even when the audio signals have different time lengths. Accordingly, there is an advantage in that load of processing required to compare tones of audio signals is reduced.

A typical example of the audio signal is a signal generated by receiving vocal sound or musical sound of a piece of music. The term "piece of music" or "music" refers to a time sequence of a plurality of sounds, no matter whether it is all or part of a piece of music created as a single work. Although the bandwidth of each unit band is arbitrary, each unit band may be set to a bandwidth corresponding to, for example, one octave.

In a preferred embodiment of the invention, the difference generation part comprises: a weight generation part that generates a sequence of weights from the component matrix in correspondence to the sequence of the unit periods, the weight corresponding to a series of component values arranged in the frequency axis direction at the corresponding unit period; a difference calculation part that generates each initial difference matrix composed of an array of difference values of component values between each shift matrix and the component matrix; and a correction part that generates each difference matrix by applying the sequence of the weights to each initial difference matrix.

In this embodiment, a difference matrix, in which the distribution of difference values arranged in the time-axis direction has been corrected based on the initial difference matrix by applying the weight sequence to the initial difference matrix, is generated. Accordingly, there is an advantage in that it is possible to, for example, generate a tonal feature amount in which the difference between the component matrix and the shift matrix is emphasized for each unit period having large component values of the component matrix (i.e., a tonal feature amount which emphasizes, especially, tones of unit periods, the strength of which is high in the audio signal).

In a preferred embodiment of the invention, the feature amount extraction part generates the tonal feature amount including a series of feature values derived from the component matrix in correspondence to the series of the unit bands, each feature value corresponding to a sequence of component values of the component matrix arranged in the time-axis direction at the corresponding unit band.

In this embodiment, the advantage of ease of estimation of the tone of the audio signal is especially significant since the tonal feature amount includes a feature value series derived from the component matrix, in which the average tonal tendency (frequency characteristic) over the entirety of the audio signal is reflected, in addition to a plurality of feature value series derived from the plurality of difference matrices in which the temporal change tendency of the tone of the audio signal is reflected.

The invention may also be specified as an audio analysis apparatus that compares tonal feature amounts generated respectively for audio signals in each of the above embodiments. An audio analysis apparatus that is preferable for comparing tones of audio signals comprises a storage part that stores a tonal feature amount for each of first and second ones of an audio signal; and a feature comparison part that calculates a similarity index value indicating tonal similarity between the first audio signal and the second audio signal by comparing the tonal feature amounts of the first audio signal and the second audio signal with each other, wherein the tonal feature amount is derived based on a component matrix of the audio signal which is divided into a sequence of unit periods in a time-axis direction and based on a plurality of shift matrices derived from the component matrix, the component matrix being composed of an array of component values, columns of the component matrix corresponding to the sequence of unit periods of the audio signal and rows of the component matrix corresponding to a series of unit bands of the audio signal arranged in a frequency-axis direction, the component value representing a spectrum component of the audio signal belonging to the corresponding unit period and belonging to the corresponding unit band, each shift matrix being obtained by shifting the columns of the component matrix in the time-axis direction with a different shift amount, and wherein the tonal feature amount includes a plurality of series of feature values corresponding to a plurality of difference matrices which are derived from the plurality of the shift matrices, each difference matrix being composed of an array of element values each representing a difference between the corresponding component value of each shift matrix and the corresponding component value of the component matrix, one series of feature values corresponding to the series of unit bands of the difference matrix, one feature value representing a sequence of element values arranged in the time-axis direction at the corresponding unit band of the difference matrix.

In this configuration, since the amount of data of the tonal feature amount is reduced by representing the tendency of temporal change of the tone of the audio signal by a plurality of feature value series, it is possible to reduce capacity required for the storage part, compared to the prior art configuration (for example, Jouni Paulus and Anssi Klapuri, "Measuring the Similarity of Rhythmic Patterns", Proc. ISMIR 2002, p. 150-156) in which a feature amount is extracted for each unit period. In addition, since the number of the feature value series does not depend on the time length of the audio signal, it is possible to easily compare temporal changes of the tones of audio signals even when the audio signals have different time lengths. Accordingly, there is also an advantage in that load of processing associated with the feature comparison part is reduced.

The audio analysis apparatus according to each of the above embodiments may not only be implemented by hardware (electronic circuitry) such as a Digital Signal Processor (DSP) dedicated to analysis of audio signals but may also be implemented through cooperation of a general arithmetic processing unit such as a Central Processing Unit (CPU) with a program. The program according to the invention is executable by a computer to perform processes of: acquiring a component matrix composed of an array of component values from an audio signal which is divided into a sequence of unit periods in a time-axis direction, columns of the component matrix corresponding to the sequence of unit periods of the audio signal and rows of the component matrix corresponding to a series of unit bands of the audio signal arranged in a frequency-axis direction, the component value representing a spectrum component of the audio signal belonging to the corresponding unit period and belonging to the corresponding unit band; generating a plurality of shift matrices each obtained by shifting the columns of the component matrix in the time-axis direction with a different shift amount; generating a plurality of difference matrices each composed of an array of element values in correspondence to the plurality of the shift matrices, the element value representing a difference between the corresponding component value of the shift matrix and the corresponding component value of the component matrix; and generating a tonal feature amount including a plurality of series of feature values corresponding to the plurality of difference matrices, one series of feature values corresponding to the series of unit bands of the difference matrix, one feature value representing a sequence of element values arranged in the time-axis direction at the corresponding unit band of the difference matrix.

The program achieves the same operations and advantages as those of the audio analysis apparatus according to the invention. The program of the invention may be provided to a user through a computer readable storage medium storing the program and then installed on a computer and may also be provided from a server device to a user through distribution over a communication network and then installed on a computer.

DETAILED DESCRIPTION OF THE INVENTION

A: First Embodiment

Figure 1:
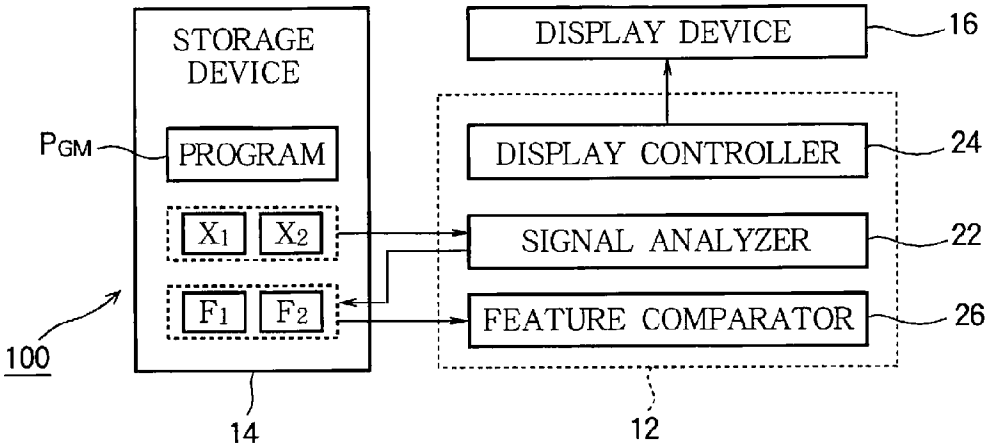
FIG. 1 is a block diagram of an audio analysis apparatus according to an embodiment of the invention.

FIG. 1 is a block diagram of an audio analysis apparatus 100 according to an embodiment of the invention. The audio analysis apparatus 100 is a device for analyzing the characteristics of sounds (musical sounds or vocal sounds) included in a piece of music and is implemented through a computer system including an arithmetic processing unit 12, a storage device 14, and a display device 16.

The storage device 14 stores various data used by the arithmetic processing unit 12 and a program PGM executed by the arithmetic processing unit 12. Any known machine readable storage medium such as a semiconductor recording medium or a magnetic recording medium or a combination of various types of recording media may be employed as the storage device 14.

As shown in FIG. 1, the storage device 14 stores audio signals X (X1, X2). Each audio signal X is a signal representing temporal waveforms of sounds included in a piece of music and is prepared for, for example, a section, from which it is possible to identify a melody or a rhythm of the piece of music (for example, a section corresponding to a specific number of measures in the piece of music). The audio signal X1 and the audio signal X2 represent parts of different pieces of music. However, it is also possible to employ a configuration in which the audio signal X1 and the audio signal X2 represent different parts of the same piece of music or a configuration in which the audio signal X represents the entirety of a piece of music.

The arithmetic processing unit 12 implements a plurality of functions (including a signal analyzer 22, a display controller 24, and a feature comparator 26) required to analyze each audio signal X through execution of the program PGM stored in the storage device 14. The signal analyzer 22 generates a tonal feature amount F(F1, F2) representing the features of the tone color or timbre of the audio signal X. The display controller 24 displays the tonal feature amount F generated by the signal analyzer 22 as an image on the display device 16 (for example, a liquid crystal display). The feature comparator 26 compares the tonal feature amount F1 of the first audio signal X1 and the tonal feature amount F2 of the second audio signal X2. It is also possible to employ a configuration in which each function of the arithmetic processing unit 12 is implemented through a dedicated electronic circuit (DSP) or a configuration in which each function of the arithmetic processing unit 12 is distributed on a plurality of integrated circuits.

Figure 2:
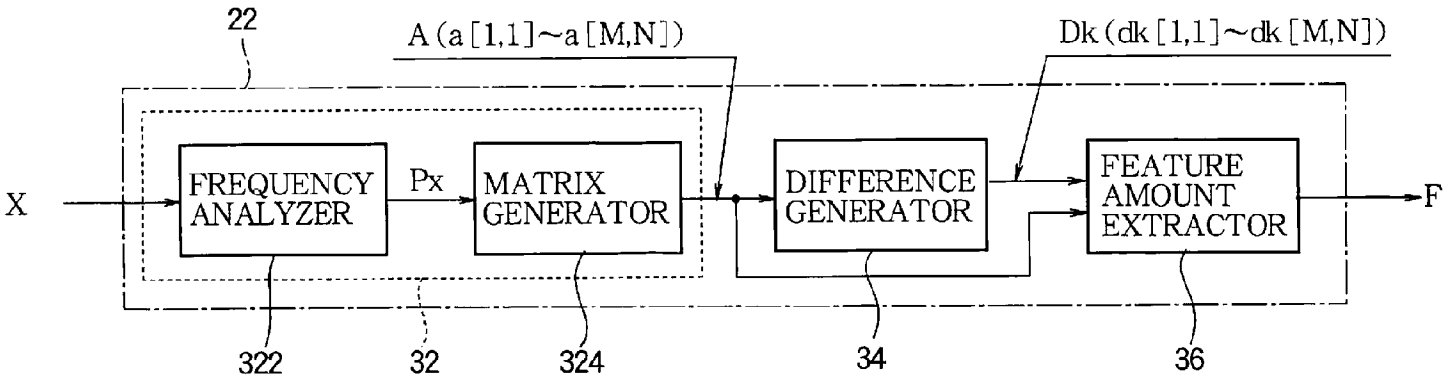
FIG. 2 is a block diagram of a signal analyzer.

FIG. 2 is a block diagram of the signal analyzer 22. As shown in FIG. 2, the signal analyzer 22 includes a component acquirer 32, a difference generator 34, and a feature amount extractor 36. The component acquirer 32 generates a component matrix A representing temporal changes of frequency characteristics of the audio signal X. As shown in FIG. 2, the component acquirer 32 includes a frequency analyzer 322 and a matrix generator 324.

Figure 3:
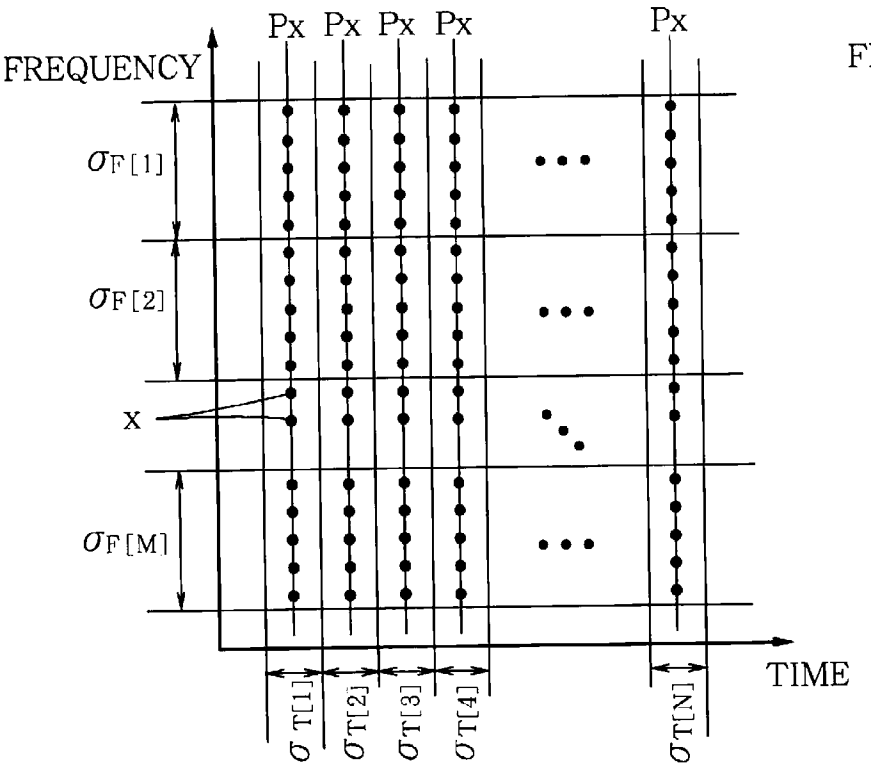
FIGS. 3(A) and 3(B) are a schematic diagram illustrating relationships between a component matrix and a time sequence of the spectrum of an audio signal.
Figure 3:
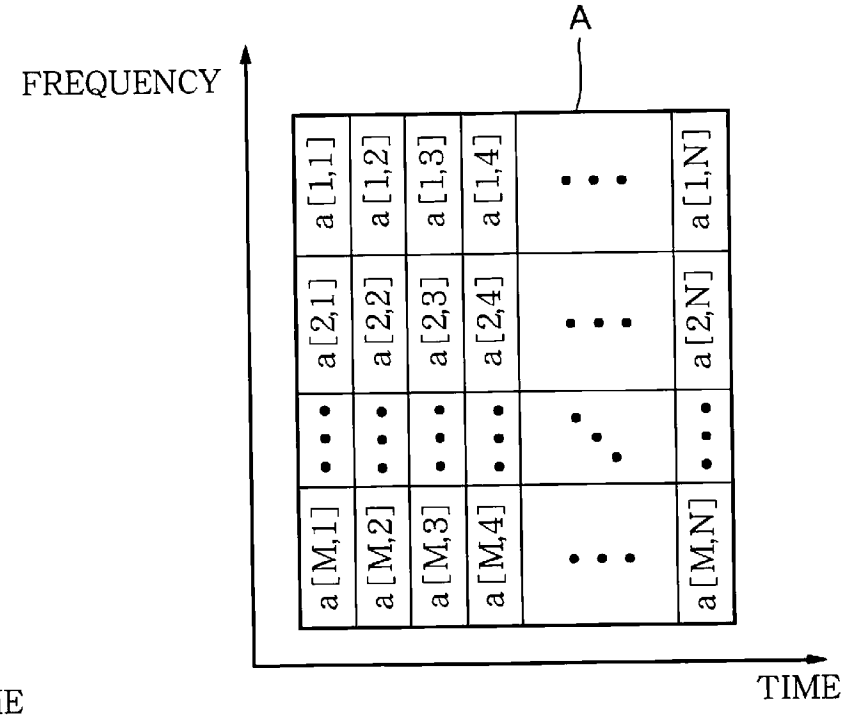

The frequency analyzer 322 generates a spectrum PX of the frequency domain for each of N unit periods (frames) σT[1] to σT[N] having a predetermined length into which the audio signal X is divided, where N is a natural number greater than 1. FIG. 3(A) is a schematic diagram of a time sequence (i.e., a spectrogram) of the spectrum PX generated by the frequency analyzer 322. As shown in FIG. 3(A), the spectrum PX of the audio signal X is a power spectrum in which the respective component values (strengths or magnitudes) x of frequency components of the audio signal X are arranged on the frequency axis. Since each unit period σT[n] (n=1~N) is set to a predetermined length, the total number N of unit periods σT[n] varies depending on the time length of the audio signal X. The component acquirer 32 may use any known frequency analysis method such as, for example, short time Fourier transform to generate the spectrum PX.

The matrix generator 324 of FIG. 2 generates a component matrix A from the time sequence of the spectrum PX generated by the frequency analyzer 322. As shown in FIG. 3(B), the component matrix A is an M×N matrix of component values a[1, 1] to a[M, N] arranged in M rows and N columns, where M is a natural number greater than 1. Assuming that M unit bands σF[1] to σF[M] are defined on the frequency axis, the matrix generator 324 calculates each component value a[m, n] of the component matrix A according to a plurality of component values x in the mth unit band σF[n] in the spectrum PX of the nth unit period σT[n] on the time axis. For example, the matrix generator 324 calculates, as the component value a[m, n], an average (arithmetic average) of a plurality of component values x in the unit band σF[m]. As can be understood from the above description, the component matrix A is a matrix of component values a[m, n], each corresponding to an average strength of a corresponding unit band σF[m] in a corresponding unit period σT[n] of the audio signal X, which are arranged in M rows and N columns, the M rows being arranged in the frequency-axis direction (i.e., in the vertical direction), the N columns being arranged in the time-axis direction (i.e., in the horizontal direction). Each of the unit bands σF[1] to σF[M] is set to a bandwidth corresponding to one octave.

Figure 4:
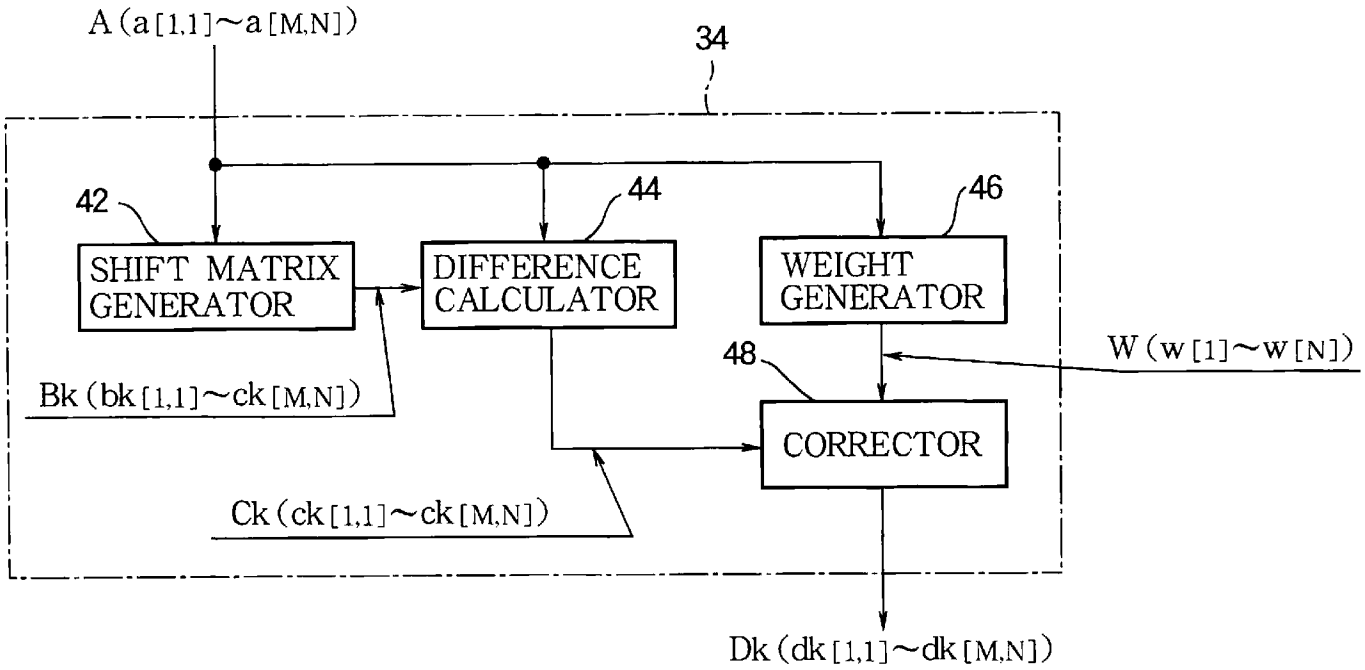
FIG. 4 is a block diagram of a difference generator.
Figure 5:
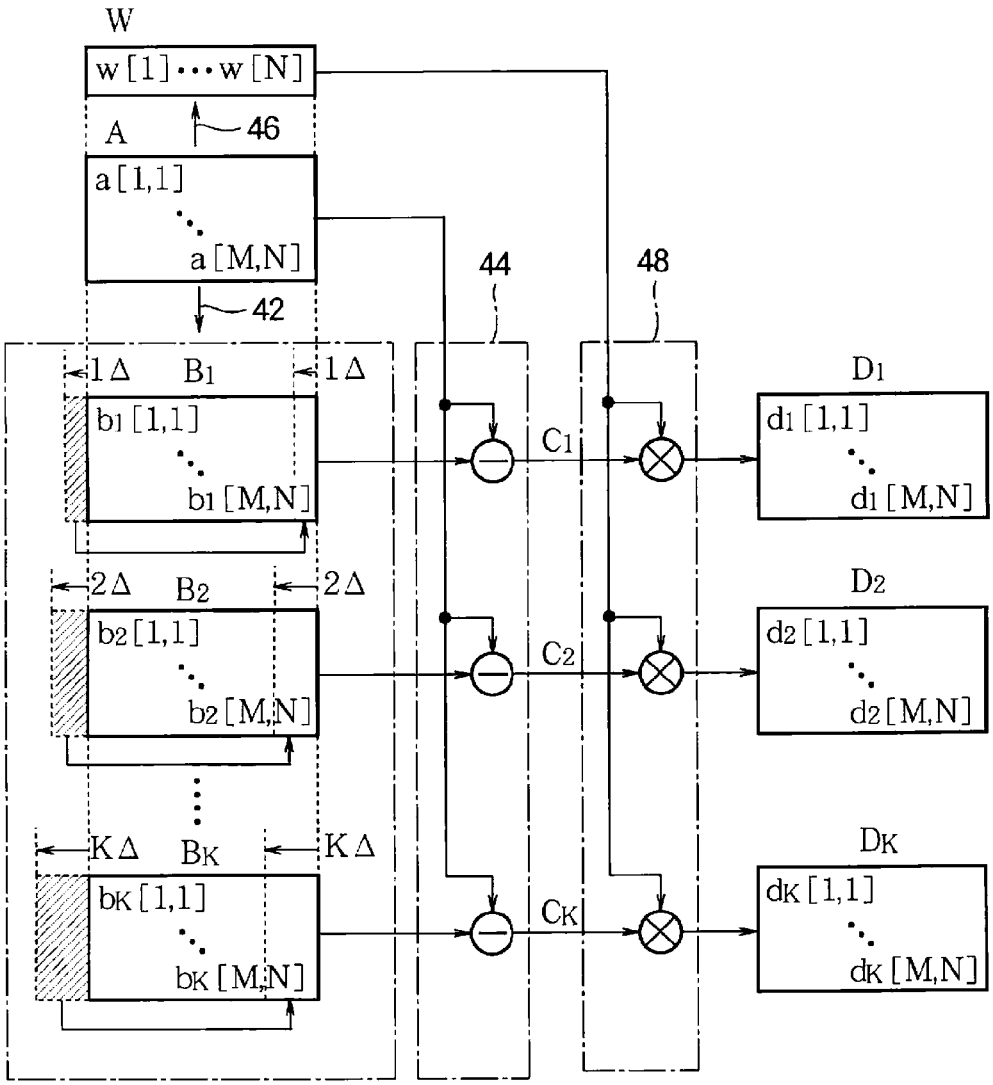
FIG. 5 is a diagram illustrating operation of the difference generator.

The difference generator 34 generates K different difference matrices D1 to DK from the component matrix A, where K is a natural number greater than 1. FIG. 4 is a block diagram of the difference generator 34 and FIG. 5 is a diagram illustrating operation of the difference generator 34. As shown in FIG. 4, the difference generator 34 includes a shift matrix generator 42, a difference calculator 44, a weight generator 46, and a corrector 48. In FIG. 5, the reference numbers of the elements of the difference generator 34 are written at locations corresponding to processes performed by the elements.

The shift matrix generator 42 of FIG. 4 generates K shift matrices B1 to BK corresponding to the different difference matrices Dk (k=1~K) from the single component matrix A. As shown in FIG. 5, each shift matrix Bk is a matrix obtained by shifting each component value a[m, n] of the component matrix A by a shift amount kΔ different for each shift matrix Bk along the time-axis direction. Each shift matrix Bk includes component values bk[1, 1] to bk[M, N] arranged in M rows and N columns, the M rows being arranged in the frequency-axis direction and the N columns being arranged in the time-axis direction. That is, a component value bk[m, n] located in the mth row and the nth column among the component values of the shift matrix Bk corresponds to a component value a[m, n+kΔ] located in the mth row and the (n+kΔ) th column of the component matrix A.

The unit Δ of the shift amount kΔ is set to a time length corresponding to one unit period σT[n]. That is, the shift matrix Bk is a matrix obtained by shifting each component value a[m, n] of the component matrix A by k unit periods σT[n] to the front side of the time-axis direction (i.e., backward in time). Here, component values a[m, n] of a number of columns of the component matrix A (hatched in FIG. 5), which correspond to the shift amount kΔ from the front edge in the time-axis direction of the component matrix A (i.e., from the 1st column), are added (i.e., circularly shifted) to the rear edge in the time-axis direction of the shift matrix Bk. That is, the 1st to kΔth columns of the the component matrix A are used as the {M−(kΔ−1)}th to Mth columns of the shift matrix Bk. For example, in the case where the unit Δ is set to a time length corresponding to a single unit period σT[n], the shift matrix B1 is constructed by shifting the 1st column of the component matrix A to the Mth column and the shift matrix B2 is constructed by shifting the 1st and 2nd columns of the component matrix A to the (M−1)th and the Mth column.

The difference calculator 44 of FIG. 4 generates an initial difference matrix Ck corresponding to the difference between the component matrix A and the shift matrix Bk for each of the K shift matrices B1 to BK. The initial difference matrix Ck is an array of difference values ck[1, 1] to ck[M, N] arranged in M rows and N columns, the M rows being arranged in the frequency-axis direction and the N columns being arranged in the time-axis direction. As shown in FIG. 5, each difference value ck[m, n] of the initial difference matrix Ck is set to an absolute value of the difference between the component value a[m, n] of the component matrix A and the component value bk[m, n] of the shift matrix Bk (i.e., ck[m, n]=|a[m, n]−bk[m, n]|). Since the shift matrix Bk is generated by shifting the component matrix A, the difference value ck[m, n] of the initial difference matrix Ck is set to a greater number as a greater change is made to the strength of components in the unit band σF[m] of the audio signal X within a period that spans the shift amount kΔ from each unit period σT[n] on the time axis.

The weight generator 46 of FIG. 4 generates a weight sequence W used to correct the initial difference matrix Ck. The weight sequence W is a sequence of N weights w[1] to w[N] corresponding to different unit periods σTn as shown in FIG. 5. The nth weight w[n] of the weight sequence W is set according to M component values a[1, *n*] to a[M, n] corresponding to the unit period σT[n] among component values of the component matrix A. For example, the sum or average of the M component values a[1, *n*] to a[M, n] is calculated as the weight w[n]. Accordingly, the weight w[n] increases as the strength (sound volume) of the unit period σT[n] over the entire band of the audio signal X increases. That is, a time sequence of the weights w[1] to w[N] corresponds to an envelope of the temporal waveform of the audio signal X.

The corrector 48 of FIG. 4 generates K difference matrices D1 to DK corresponding to K initial difference matrices Ck by applying the weight sequence W generated by the weight generator 46 to the initial difference matrices Ck (C1 to CK). As shown in FIG. 5, the difference matrix Dk is a matrix composed of an array of element values dk[1, 1] to dk[M, N] arranged in M rows and N columns, the M rows being arranged in the frequency-axis direction (i.e., in the vertical direction), the N columns being arranged in the time-axis direction (i.e., in the horizontal direction). Each element value dk[m, n] of the difference matrix Dk is set to a value obtained by multiplying a difference value ck[m, n] in the nth column of the initial difference matrix Ck by the nth weight w[n] of the weight sequence W (i.e., dk[m, n]=w[n]×ck[m, n]). Accordingly, each element value dk[m, n] of the difference matrix Dk is emphasized to a greater value, compared to the difference value ck[m, n] of the initial difference matrix Ck, as the strength of the audio signal X in the unit period σT[n] increases. That is, the corrector 48 functions as an element for correcting (emphasizing levels of) the distribution of N difference values ck[m, 1] to ck[m, N] arranged in the time-axis direction in the unit band σF[m].

Figure 6:
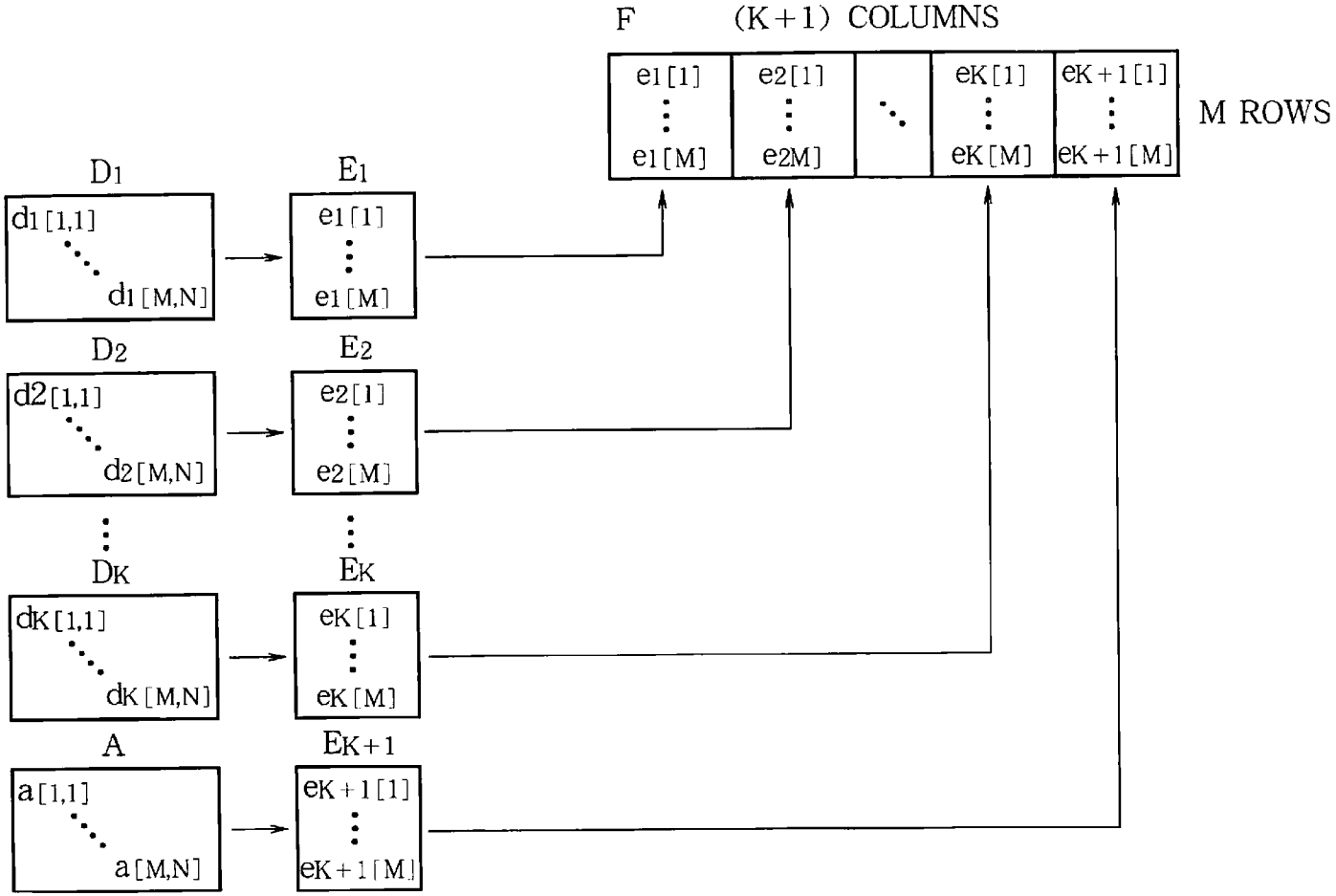
FIG. 6 is a diagram illustrating operation of a feature amount extractor.

The feature amount extractor 36 of FIG. 2 generates a tonal feature amount F (F1, F2) of the audio signal X using the component matrix A generated by the component acquirer 32 and the K difference matrices D1 to DK generated by the difference generator 34. FIG. 6 is a diagram illustrating operation of the feature amount extractor 36. As shown in FIG. 6, the tonal feature amount F generated by the feature amount extractor 36 is an M×(K+1) matrix in which a plurality of K feature value series E1 to EK corresponding to a plurality of difference matrices Dk and one feature value series EK+1 corresponding to the component matrix A are arranged. Thus, the number M of rows and the number (K+1) of columns of the tonal feature amount F do not depend on the time length of the audio signal X (i.e., the total number N of unit periods σT[n]).

The feature value series EK+1 located at the (K+1)th column of the tonal feature amount F is a sequence of M feature values eK+1[1] to eK+1[M] corresponding to different unit bands σF[m]. The element value eK+1[m] is set according to N component values a[m, 1] to a[m, N] corresponding to the unit band σF[m] among component values of the component matrix A generated by the component acquirer 32. For example, the sum or average of the N component values a[m, 1] to a[m, N] is calculated as the feature value eK+1[m]. Accordingly, the feature value eK+1[m] increases as the strength of the components of the unit band σF[m] over the entire period of the audio signal X increases. That is, the feature value eK+1[m] serves as a feature amount representing an average tone (average frequency characteristics) of the audio signal X over the entire period of the audio signal X.

The feature value series Ek (E1 to EK) is a sequence of M feature values ek[1] to ek[M] corresponding to different unit band σF[m]. The mth feature value ek[m] of the feature value series Ek is set according to N element values dk[m, 1] to dk[m, N] corresponding to the unit band σF[m] among element values of the difference matrix Dk. For example, the sum or average of the N element values dk[m, 1] to dk[m, N] is calculated as the feature value ek[m]. As can be understood from the above description, the feature value ek[m] is set to a greater value as the strength of the components in the unit band σF[m] of the audio signal X in each of the unit periods σT[1] to σT[N] more significantly changes in a period that spans the shift amount kΔ from the unit period σTn. Accordingly, in the case where the K feature values e1[m] to eK[m] (arranged in the horizontal direction) corresponding to each unit band σF[m] in the tonal feature amount F include many great feature values ek[m], it is estimated that the components of the unit band σF[m] of the audio signal X are components of sound whose strength rapidly changes in a short time. On the other hand, in the case where the K feature values e1[m] to eK[m] corresponding to each unit band σF[m] include many small feature values ek[m], it is estimated that the components of the unit band σF[m] of the audio signal X are components of sound whose strength does not greatly change over a long time (or that the components of the unit band σF[m] are not generated). That is, the K feature value series E1 to EK included in the tonal feature amount F serve as a feature amount indicating temporal changes of the components of each unit band σF[m] of the audio signal X (i.e., temporal changes of tone of the audio signal X).

The configuration and operation of the signal analyzer 22 of FIG. 1 have been described above. The signal analyzer 22 sequentially generates the tonal feature amount F1 of the first audio signal X1 and the tonal feature amount F2 of the second audio signal X2 through the above procedure. The tonal feature amounts F generated by the signal analyzer 22 are provided to the storage device 14.

Figure 7:
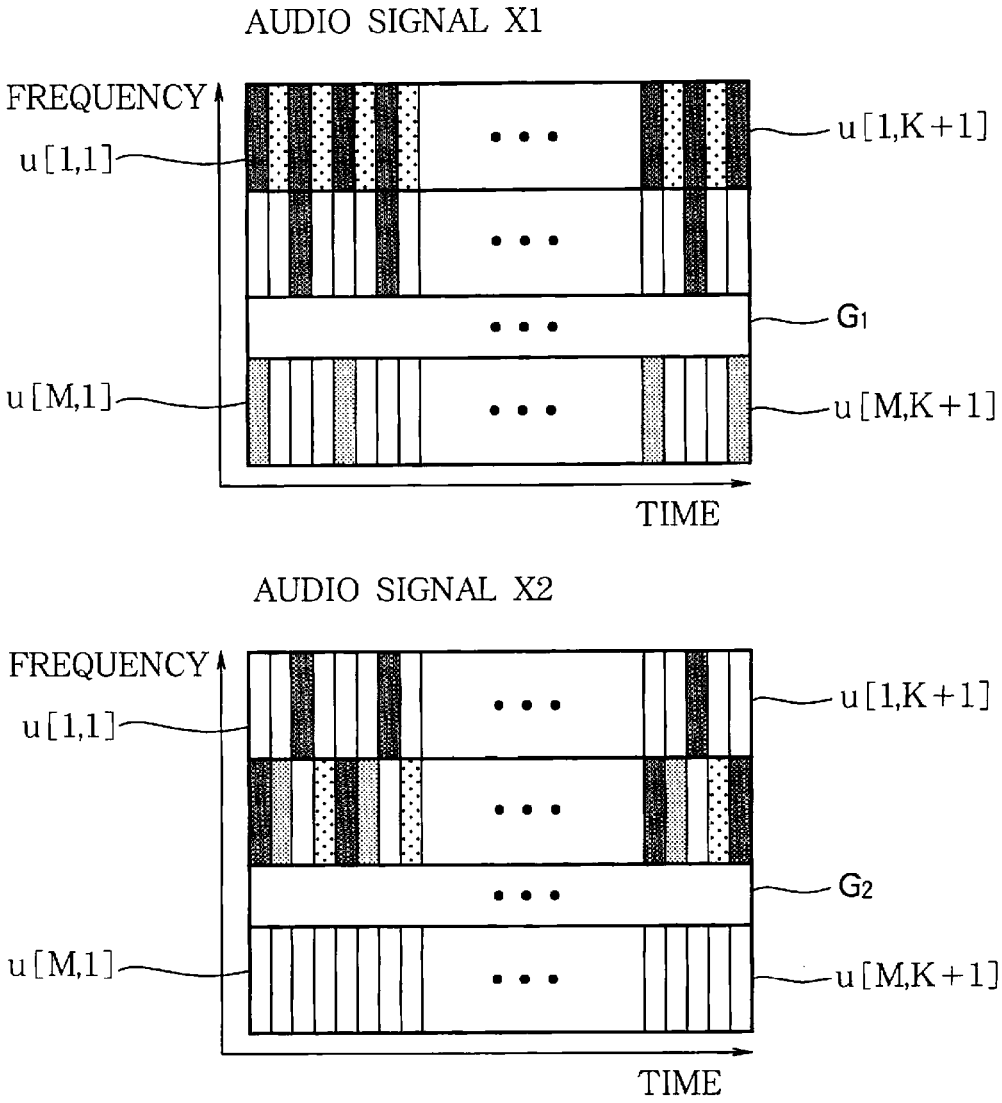
FIG. 7 is a schematic diagram of a tone image.

The display controller 24 displays tone images G (G1, G2) of FIG. 7 schematically and graphically representing the tonal feature amounts F (F1, F2) generated by the signal analyzer 22 on the display device 16. FIG. 7 illustrates an example in which the tone image G1 of the tonal feature amount F1 of the audio signal X1 and the tone image G2 of the tonal feature amount F2 of the audio signal X2 are displayed in parallel.

As shown in FIG. 7, each tone image G is a mapping pattern in which unit figures u[m, κ] corresponding to the element values eκ[m] of the tonal feature amount F (κ=1~K+1) are mapped in a matrix of M rows and (K+1) columns along the horizontal axis corresponding to the time axis and along the frequency axis (vertical axis) perpendicular to the horizontal axis. The tone image G1 of the audio signal X1 and the tone image G2 of the audio signal X2 are displayed in contrast with respect to the common horizontal axis (time axis).

As shown in FIG. 7, a display form (color or gray level) of a unit figure u[m, κ] located at an mth row and an nth column in the tone image G1 is variably set according to a feature value eκ[m] in the tonal feature amount F1. Similarly, a display form of each unit figure u[m, κ] of the tone image G2 is variably set according to a feature value eκ[m] in the tonal feature amount F2. Accordingly, the user who has viewed the tone images G can intuitively identify and compare the tendencies of the tones of the audio signal X1 and the audio signal X2.

Specifically, the user can easily identify the tendency of the average tone (frequency characteristics) of the audio signal X over the entire period of the audio signal X from the M unit figures u(1, K+1) to u(M, K+1) (the feature value series EK+1) of the (K+1)th column among the unit figures of the tone image G. The user can also easily identify the tendency of temporal changes of the components of each unit band σF[m] (i.e., each octave) of the audio signal X from the unit figures u(m, k) of the 1st to Kth columns among the unit figures of the tone image G. In addition, the user can easily compare the tone of the audio signal X1 and the tone of the audio signal X2 since the number M of rows and the number (K+1) of columns of the unit figures u[m, κ] are common to the tone image G1 and the tone image G2 regardless of the time length of each audio signal X.

The feature comparator 26 of FIG. 1 calculates a value (hereinafter referred to as a "similarity index value") Q which is a measure of the tonal similarity between the audio signal X1 and audio signal X2 by comparing the tonal feature amount F1 of the audio signal X1 and the tonal feature amount F2 of the audio signal X2. Although any method may be employed to calculate the similarity index value Q, it is possible to employ a configuration in which differences between corresponding feature values eκ[m] in the tonal feature amount F1 and the tonal feature amount F2 (i.e., differences between feature values eκ[m] located at corresponding positions in the two matrices) are calculated and the sum or average of absolute values of the differences over the M rows and the (K+1) columns is calculated as the similarity index value Q. That is, the similarity index value Q decreases as the similarity between the tonal feature amount F1 of the audio signal X1 and the tonal feature amount F2 of the audio signal X2 increases. The similarity index value Q calculated by the feature comparator 26 is displayed on the display device 16, for example, together with the tone images G (G1, G2) of FIG. 7. The user can quantitatively determine the tonal similarity between the audio signal X1 and the audio signal X2 from the similarity index value Q.

In the above embodiment, the tendency of the average tone of the audio signal X over the entire period of the audio signal X is represented by the feature value series EK+1 and the tendency of temporal changes of the tone of the audio signal X over the entire period of the audio signal X is represented by K feature value series E1 to EK corresponding to the number of shift matrices Bk (i.e., the number of feature amounts kΔ). Accordingly, it is possible to reduce the amount of data required to estimate the tone color or timbre of a piece of music, compared to the prior art configuration (for example, Jouni Paulus and Anssi Klapuri, "Measuring the Similarity of Rhythmic Patterns", Proc. ISMIR 2002, p. 150-156) in which a feature amount such as an MFCC is extracted for each unit period σT[n]. In addition, since feature values eκ[m] of the tonal feature amount F are calculated using unit bands σF[m], each including a plurality of component values x, as frequency-axis units, the amount of data of the tonal feature amount F is reduced, for example, compared to the prior art configuration in which a feature value is calculated for each frequency corresponding to each component value x. There is also an advantage in that the user can easily identify the range of each feature value eκ[1] to eκ[M] of the tonal feature amount F since each unit band σF[m] is set to a bandwidth of one octave.

Further, since the number K of the feature value series E1 to EK representing the temporal change of the tone of the audio signal X does not depend on the time length of the audio signal X, the user can easily estimate the tonal similarity between the tone of the audio signal X1 and the tone of the audio signal X2 by comparing the tone image G1 and the tone image G2 even when the time lengths of the audio signal X1 and the audio signal X2 are different. Furthermore, in principle, the process for locating corresponding time points between the audio signal X1 and the audio signal X2 (for example, DP matching required in the technology of Jouni Paulus and Anssi Klapuri, "Measuring the Similarity of Rhythmic Patterns", Proc. ISMIR 2002, p. 150-156) is unnecessary since the number M of rows and the number (K+1) of columns of the tonal feature amount F do not depend on the audio signal X. Therefore, there is also an advantage in that load of processing for comparing the tones of the audio signal X1 and the audio signal X2 (i.e., load of the feature comparator 26) is reduced.

<Modifications>

Various modifications can be made to each of the above embodiments. The following are specific examples of such modifications. Two or more modifications selected from the following examples may be combined as appropriate.

(1) Modification 1

The method of calculating the component value a[m, n] of each unit band σF[m] is not limited to the above method in which an average (arithmetic average) of a plurality of component values x in the unit band σF[m] is calculated as the component value a[m, n]. For example, it is possible to employ a configuration in which the weighted sum, the sum, or the middle value of the plurality of component values x in the unit band σF[m] is calculated as the component value a[m, n] or a configuration in which each component value x is directly used as the component value a[m, n] of the component matrix A. In addition, the bandwidth of the unit band σF[m] may be arbitrarily selected without being limited to one octave. For example, it is possible to employ a configuration in which each unit band σF[m] is set to a bandwidth corresponding to a multiple of one octave or a bandwidth corresponding to a divisional of one octave divided by an integer.

(2) Modification 2

Although the initial difference matrix Ck is corrected to the difference matrix Dk using the weight sequence W in the above embodiment, it is possible to omit correction using the weight sequence W. For example, it is possible to employ a configuration in which the feature amount extractor 36 generates the tonal feature amount F using the initial difference matrix Ck calculated by the difference calculator 44 of FIG. 4 as the difference matrix Dk (such that the weight generator 46, the corrector 48, and the like are omitted).

(3) Modification 3

Although the tonal feature amount F including the K feature value series E1 to EK generated from difference matrices Dk and the feature value series EK+1 corresponding to the component matrix A is generated in the above embodiment, the feature value series EK+1 may be omitted from the tonal feature amount F.

(4) Modification 4

Although each shift matrix Bk is generated by shifting the component values a[m, n] at the front edge of the component matrix A to the rear edge in the above embodiment, the method of generating the shift matrix Bk by the shift matrix generator 42 may be modified as appropriate. For example, it is possible to employ a configuration in which a shift matrix Bk of m rows and (N−kΔ) columns is generated by eliminating a number of columns corresponding to the shift amount kΔ at the front side of the component matrix A from among the columns of the component matrix A. The difference calculator 44 generates an initial difference matrix Ck of m rows and (N−kΔ) columns by calculating difference values ck[m, n] between the component values a[m, n] and the component values dk[m, n] only for an overlapping portion of the component matrix A and the shift matrix Bk. Although each component value a[m, n] of the component matrix A is shifted to the front side of the time axis in the above example, it is also possible to employ a configuration in which the shift matrix Bk is generated by shifting each component value a[m, n] to the rear side of the time axis (i.e., forward in time).

(5) Modification 5

Although the frequency analyzer 322 of the component acquirer 32 generates the spectrum PX from the audio signal X while the matrix generator 324 generates the component matrix A from the time sequence of the PX in the above embodiment, the component acquirer 32 may acquire the component matrix A using any other method. For example, it is possible to employ a configuration in which the component matrix A of the audio signal X is stored in the storage device 14 in advance (such that storage of the audio signal X may be omitted) and the component acquirer 32 acquires the component matrix A from the storage device 14. It is also possible to employ a configuration in which a time sequence of each spectrum PX of the audio signal X is stored in the storage device 14 in advance (such that storage of the audio signal X or the frequency analyzer 322 may be omitted) and the component acquirer 32 (the matrix generator 324) generates the component matrix A from the spectrum PX in the storage device 14. That is, the component acquirer 32 may be any element for acquiring the component matrix A.

(6) Modification 6

Although the audio analysis apparatus 100 includes both the signal analyzer 22 and the feature comparator 26 in the above example, the invention may also be realized as an audio analysis apparatus including only one of the signal analyzer 22 and the feature comparator 26. That is, an audio analysis apparatus used to analyze the tone of the audio signal X (i.e., used to extract the tonal feature amount F) (hereinafter referred to as a "feature extraction apparatus") may have a configuration in which the signal analyzer 22 is provided while the feature comparator 26 is omitted. On the other hand, an audio analysis apparatus used to compare the tones of the audio signal X1 and the audio signal X2 (i.e., used to calculate the similarity index value Q) (hereinafter referred to as a "feature comparison apparatus") may have a configuration in which the feature comparator 26 is provided while the signal analyzer 22 is omitted. The tonal feature amounts F (F1, F2) generated by the signal analyzer 22 of the feature extraction apparatus is provided to the feature comparison apparatus through, for example, a communication network or a portable recording medium and is then stored in the storage device 14. The feature comparator 26 of the feature comparison apparatus calculates the similarity index value Q by comparing the tonal feature amount F1 and the tonal feature amount F2 stored in the storage device 14.

What is claimed is:

1. An audio analysis apparatus comprising:

a component acquisition part that acquires a component matrix composed of an array of component values from an audio signal which is divided into a sequence of unit periods in a time-axis direction, columns of the component matrix corresponding to the sequence of unit periods of the audio signal and rows of the component matrix corresponding to a series of unit bands of the audio signal arranged in a frequency-axis direction, the component value representing a spectrum component of the audio signal belonging to the corresponding unit period and belonging to the corresponding unit band;

a difference generation part that generates a plurality of shift matrices each obtained by shifting the columns of the component matrix in the time-axis direction with a different shift amount, and that generates a plurality of difference matrices each composed of an array of element values in correspondence to the plurality of the shift matrices, the element value representing a difference between the corresponding component value of the shift matrix and the corresponding component value of the component matrix; and a feature amount extraction part that generates a tonal feature amount including a plurality of series of feature values corresponding to the plurality of difference matrices, one series of feature values corresponding to the series of unit bands of the difference matrix, one feature value representing a sequence of element values arranged in the time-axis direction at the corresponding unit band of the difference matrix.

2. The audio analysis apparatus according to claim 1, wherein the difference generation part comprises:

a weight generation part that generates a sequence of weights from the component matrix in correspondence to the sequence of the unit periods, the weight corresponding to a series of component values arranged in the frequency axis direction at the corresponding unit period;

a difference calculation part that generates each initial difference matrix composed of an array of difference values of component values between each shift matrix and the component matrix; and a correction part that generates each difference matrix by applying the sequence of the weights to each initial difference matrix.

3. The audio analysis apparatus according to claim 1, wherein the feature amount extraction part generates the tonal feature amount including a series of feature values derived from the component matrix in correspondence to the series of the unit bands, each feature value corresponding to a sequence of component values of the component matrix arranged in the time-axis direction at the corresponding unit band.

4. An audio analysis apparatus comprising:

a storage part that stores a tonal feature amount for each of first and second ones of an audio signal; and a feature comparison part that calculates a similarity index value indicating tonal similarity between the first audio signal and the second audio signal by comparing the tonal feature amounts of the first audio signal and the second audio signal with each other, wherein the tonal feature amount is derived based on a component matrix of the audio signal which is divided into a sequence of unit periods in a time-axis direction and based on a plurality of shift matrices derived from the component matrix, the component matrix being composed of an array of component values, columns of the component matrix corresponding to the sequence of unit periods of the audio signal and rows of the component matrix corresponding to a series of unit bands of the audio signal arranged in a frequency-axis direction, the component value representing a spectrum component of the audio signal belonging to the corresponding unit period and belonging to the corresponding unit band, each shift matrix being obtained by shifting the columns of the component matrix in the time-axis direction with a different shift amount, and wherein the tonal feature amount includes a plurality of series of feature values corresponding to a plurality of difference matrices which are derived from the plurality of the shift matrices, each difference matrix being composed of an array of element values each representing a difference between the corresponding component value of each shift matrix and the corresponding component value of the component matrix, one series of feature values corresponding to the series of unit bands of the difference matrix, one feature value representing a sequence of element values arranged in the time-axis direction at the corresponding unit band of the difference matrix.

5. A non-transitory machine readable storage medium containing an audio analysis program being executable by a computer to perform processes of:

acquiring a component matrix composed of an array of component values from an audio signal which is divided into a sequence of unit periods in a time-axis direction, columns of the component matrix corresponding to the sequence of unit periods of the audio signal and rows of the component matrix corresponding to a series of unit bands of the audio signal arranged in a frequency-axis direction, the component value representing a spectrum component of the audio signal belonging to the corresponding unit period and belonging to the corresponding unit band;

generating a plurality of shift matrices each obtained by shifting the columns of the component matrix in the time-axis direction with a different shift amount;

generating a plurality of difference matrices each composed of an array of element values in correspondence to the plurality of the shift matrices, the element value representing a difference between the corresponding component value of the shift matrix and the corresponding component value of the component matrix; and generating a tonal feature amount including a plurality of series of feature values corresponding to the plurality of difference matrices, one series of feature values corresponding to the series of unit bands of the difference matrix, one feature value representing a sequence of element values arranged in the time-axis direction at the corresponding unit band of the difference matrix.

6. A non-transitory computer-readable medium having a data structure of a tonal feature amount representing a tone color of an audio signal, wherein the tonal feature amount is derived based on a component matrix of the audio signal which is divided into a sequence of unit periods in a time-axis direction and based on a plurality of shift matrices derived from the component matrix, the component matrix being composed of an array of component values, columns of the component matrix corresponding to the sequence of unit periods of the audio signal and rows of the component matrix corresponding to a series of unit bands of the audio signal arranged in a frequency-axis direction, the component value representing a spectrum component of the audio signal belonging to the corresponding unit period and belonging to the corresponding unit band, each shift matrix being obtained by shifting the columns of the component matrix in the time-axis direction with a different shift amount, and wherein the tonal feature amount includes a plurality of series of feature values corresponding to a plurality of difference matrices which are derived from the plurality of the shift matrices, each difference matrix being composed of an array of element values each representing a difference between the corresponding component value of each shift matrix and the corresponding component value of the component matrix, one series of feature values corresponding to the series of unit bands of the difference matrix, one feature value representing a sequence of element values arranged in the time-axis direction at the corresponding unit band of the difference matrix.

* * * * *